US007296559B2

(12) United States Patent
Kaneko

(10) Patent No.: US 7,296,559 B2
(45) Date of Patent: Nov. 20, 2007

(54) ACCUMULATOR FUEL INJECTION SYSTEM

(75) Inventor: Takashi Kaneko, Sagamihara (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 11/360,913

(22) Filed: Feb. 24, 2006

(65) Prior Publication Data

US 2006/0191514 A1 Aug. 31, 2006

(30) Foreign Application Priority Data

Feb. 25, 2005 (JP) ..... 2005-051885

(51) Int. Cl.
*F02M 63/00* (2006.01)
*F02M 63/02* (2006.01)

(52) U.S. Cl. ..... 123/447; 123/456

(58) Field of Classification Search ..... 123/456, 123/447, 467, 511, 514, 468, 469
See application file for complete search history.

(56) References Cited

U.S. PATENT DOCUMENTS

| | | | | |
|---|---|---|---|---|
| 5,109,822 | A * | 5/1992 | Martin | 123/456 |
| 5,197,435 | A * | 3/1993 | Mazur et al. | 123/456 |
| 5,311,850 | A * | 5/1994 | Martin | 123/456 |
| 5,373,824 | A * | 12/1994 | Peters et al. | 123/527 |
| 5,752,486 | A | 5/1998 | Nakashima et al. | |
| 5,782,222 | A * | 7/1998 | Morris et al. | 123/456 |
| 5,845,621 | A | 12/1998 | Robinson et al. | |
| 6,470,859 | B2 * | 10/2002 | Imura et al. | 123/467 |
| 6,488,011 | B1 * | 12/2002 | Frank et al. | 123/456 |
| 6,640,783 | B2 * | 11/2003 | Braun et al. | 123/467 |
| 6,907,863 | B2 * | 6/2005 | Henmi | 123/456 |
| 2002/0053341 | A1 | 5/2002 | Imura et al. | |
| 2002/0062817 | A1 | 5/2002 | Endo | |
| 2004/0139945 | A1 | 7/2004 | Kondo | |
| 2006/0144368 | A1 * | 7/2006 | Knight et al. | 123/447 |

FOREIGN PATENT DOCUMENTS

| | | |
|---|---|---|
| DE | 10 2004 014 311 | 10/2005 |
| EP | 0 886 066 A1 | 12/1998 |
| FR | 2 845 129 | 4/2002 |
| FR | 2 852 062 | 8/2004 |
| JP | 9-170514 | 6/1997 |
| JP | 11-159372 | 6/1999 |
| JP | 2004-137990 | 5/2004 |
| JP | 2004-308464 | 11/2004 |

* cited by examiner

*Primary Examiner*—Mahmoud Gimie
(74) *Attorney, Agent, or Firm*—Wenderoth, Lind & Ponack, L.L.P.

(57) ABSTRACT

An accumulator fuel injection system has fuel pressure pulsation in a common rail caused by fuel injection suppressed in an extremely simple way with a low cost system and without using an electronic control device and so on. The accumulator fuel injection system supplies high pressure fuel accumulated in an accumulating room of the common rail through high pressure fuel outlets provided equally spaced along the longitudinal direction of the common rail to a fuel injection valve of each cylinder at predetermined injection timing. The distance from an end of the accumulating room, from where a pressure wave generated therein is reflected, to a high pressure fuel outlet adjacent to the end ($L_1$ or $L_2$) is determined in a range of (N+0.25) times to (N+0.375) times the pitch length L of the equally spaced high pressure fuel outlets each corresponding to each cylinder, N being a nonnegative integer.

13 Claims, 6 Drawing Sheets

ACCUMULATOR FUEL INJECTION SYSTEM

BACKGROUND OF THE INVENTION

1. Field of the Invention

The present invention relates to an accumulator fuel injection system with a common rail which is applied to a diesel engine, high pressure fuel being accumulated in the common rail and supplied at a constant interval to the injection nozzle of each cylinder from high pressure fuel outlet ports disposed at a constant spacing in the common rail.

2. Description of the Related Art

Accumulator fuel injection systems in which high pressure fuel accumulated in a common rail is supplied to the injection nozzle of each cylinder at determined injection timing are in heavy usage in recent years in diesel engines.

In an accumulator fuel injection system like this, pressure pulsation occurs in the common rail induced by the opening and closing of the injection nozzles. The outlet ports connecting to injection pipes are arranged with the same pitch in the common rail and the fuel injection interval is also the same for each cylinder, so a standing wave resides in the common rail, and this standing wave may affect the next injection.

In Japanese Laid-Open Patent Application No. 11-159372 is disclosed a means to eliminate the influence of the pulsation of fuel pressure in the common rail.

According to the disclosure, by use of an electronic control device, a difference of injection pressure to be corrected is determined based on the set value of fuel injection quantity, injection pressure of fuel is determined according to the pressure to be corrected with the injection valve opening period being reflected for the correction, and injection valve opening periods are controlled taking into consideration the reflection of fuel pressure so that the quantity of fuel optimal for the operating condition of the engine and for pulsating condition of fuel pressure is injected even when fuel pressure pulsation occurs in the fuel injection line and the reflection wave of fuel synchronizes with the injection of the next cylinder.

However, there is a problem in the art disclosed in the Japanese Laid-Open Patent Application No. 11-159372 in that, as a difference of injection pressure to be corrected is determined based on the set value of fuel injection quantity and the opening period of the injection valve is controlled by an electronic control device based on the corrected injection pressure taking the reflection wave of the fuel pressure into consideration, the program for calculation and control is inevitably complicated and the cost of the system is increased for providing the electronic control device.

SUMMARY OF THE INVENTION

The object of the present invention is made in light of the prior art and the object is to provide an accumulator fuel injection system with which fuel pressure pulsation in the common rail caused by fuel injection can be suppressed by extremely simple means with a low cost system.

To attain the object, the present invention proposes an accumulator fuel injection system having a common rail for supplying high pressure fuel accumulated in an accumulating room of the common rail to the fuel injection valve of each cylinder through high pressure fuel outlets provided equally spaced along the longitudinal direction of the common rail at predetermined injection timing. A distance from an end of the accumulating room from where a pressure wave generated therein is reflected to a high pressure fuel outlet adjacent to the end is determined in a range of (N+0.25) times to (N+0.375) times the pitch length L of the equally spaced high pressure fuel outlets each corresponding to each cylinder, N being a nonnegative integer.

According to the invention, as the distance from an end of the accumulating room to a high pressure fuel outlet nearest to the end is in a range of (N+0.25) times to (N+0.375) times the pitch length L of the high-pressure fuel outlets, a reflected pressure wave from the end of the accumulating room has phases different from a pressure wave advancing toward the end also in a wave of shorter wave length, that is, in a second and third harmonic wave. The advancing pressure wave is counteracted by the reflecting wave in waves other than the fundamental wave resulting in effectively suppressed fuel pressure pulsation in the accumulating room.

Therefore, the occurrence of irregular fuel injection, deviation in injection timing, and lowering in engine performance caused by these nonconformities in fuel injection can be prevented.

The present invention also proposes an accumulator fuel injection system having a common rail for supplying high pressure fuel accumulated in an accumulating room of the common rail to the fuel injection valve of each cylinder through high pressure fuel outlets provided equally spaced along the longitudinal direction of the common rail at predetermined injection timing. A distance $L_1$ from an end of the accumulating room from where a pressure wave generated therein is reflected to a high pressure fuel outlet adjacent to the end is ½ times the pitch length L of the equally spaced high pressure fuel outlets each corresponding to each cylinder, i.e. $L_1=\frac{1}{2}\cdot L$. A distance $L_2$ from the other end of the accumulating room to a high pressure fuel outlet adjacent to the other end is 3/2 times the pitch length L, i.e. $L_2=\frac{3}{2}\cdot L$.

According to the invention, as distance $L_1$ from an end of the accumulating room to a high pressure fuel outlet adjacent to the end is ½ times the pitch length L of the high pressure fuel outlets, i.e. $L_1=\frac{1}{2}\cdot L$, the reflected pressure wave of the fundamental wave reflected from the end of the accumulating room has a phase adverse to the fundamental pressure wave advancing toward the end, and the reflected wave and advancing wave counteract to each other, resulting in suppression of the fuel pressure pulsation in the accumulating room.

Further, at the other end of the accumulating room, as distance $L_2$ from the other end to a high pressure fuel outlet adjacent to the other end is 3/2 times the pitch length L of the high pressure fuel outlets, i.e. $L_2=\frac{3}{2}\cdot L$, the reflected pressure wave of the fundamental wave reflected from the other end has a phase adverse to the fundamental pressure wave advancing toward the end, and the reflected wave and advancing wave counteract to each other, resulting in suppression of the fuel pressure pulsation in the accumulating room. This case aims at the suppression of mainly the fundamental wave among the waves generated in the accumulating room by fuel injection.

Further, the present invention proposes an accumulator fuel injection system having a common rail for supplying high pressure fuel accumulated in an accumulating room of the common rail to the fuel injection valve of each cylinder through high pressure fuel outlets provided equally spaced along the longitudinal direction of the common rail at predetermined injection timing, wherein a pressure reflecting member having a plurality of projections is provided at an end part of the accumulating room from where a pressure wave generated therein is reflected, such that the projection is directed toward the accumulating room.

It is preferable to compose the invention as follows:

(1) The pressure reflecting member has a plurality of annular projections formed such that each annular projection is concentric around the center of the accumulating room and faces toward the accumulating room.

(2) The pressure reflecting member has a plurality of acerose or needlelike projections formed such that each projection faces toward the accumulating room.

According to the invention, when the pressure wave generated in the accumulating room and propagating in the longitudinal direction along the accumulating room collides against a plurality of the projections formed as annular projections or acerose or needlelike projections at the end of the pressure reflecting member, the wave colliding with each of the projections creates interference so that energy of the pressure wave is decreased and fuel pressure pulsation in the accumulating room is suppressed.

Further, the present invention proposes an accumulator fuel injection system having a common rail for supplying high pressure fuel accumulated in an accumulating room of the common rail to the fuel injection valve of each cylinder through high pressure fuel outlets provided equally spaced along the longitudinal direction of the common rail at predetermined injection timing, wherein a relief valve is provided at an end of the accumulating room for adjusting the pressure therein and a pressure sensor is provided at the other end of the accumulating room for detecting the pressure therein. A tapered portion projecting toward the accumulating room is formed with one or both of the relief valve and the pressure sensor.

According to the invention, a pressure wave generated in the accumulating room and propagating in the direction along the accumulating room collides against the tapered projection formed at the end of the relief valve or the tapered projection formed at the end of the pressure sensor. The pressure wave is reflected irregularly from the tapered projection, so that the energy of the pressure wave is decreased and fuel pressure pulsation in the accumulating room is suppressed.

Further, the present invention proposes an accumulator fuel injection system having a common rail for supplying high pressure fuel accumulated in an accumulating room of the common rail to the fuel injection valve of each cylinder through high pressure fuel outlets at predetermined injection timing. The high pressure fuel outlets corresponding to each cylinder are positioned unequally spaced such that at least one of the distances between adjacent high pressure fuel outlets is determined in a range of (N+0.25) times to (N+0.375) times the shortest distance L between adjacent high pressure fuel outlets, N being a nonnegative integer.

According to the invention, as distances between adjacent high pressure fuel outlets in the common rail are determined in a range of (N+0.25) times to (N+0.375) times the shortest distance L between adjacent high pressure fuel outlets, the pressure wave generated at a high pressure fuel outlet has a phase different from the pressure wave generated at another high pressure fuel outlet, these pressure waves counteract each other, and fuel pressure pulsation in the accumulating room is suppressed.

Therefore, the occurrence of irregular fuel injection, deviation in injection timing, and lowering in engine performance caused by these nonconformities in fuel injection can be prevented.

As has been described in the forgoing, according to the present invention, by determining a distance from an end of the accumulating room to a high pressure fuel outlet adjacent to the end to be in a range of (N+0.25) times to (N+0.375) times the pitch length L of the high pressure fuel outlets, the wave reflected from the end part of the accumulating room has a phase different from the phase of the wave advancing toward the end part in a wider range of harmonic waves and fuel pressure pulsation in the accumulating room can be suppressed.

According to the present invention, by allowing the pressure wave propagating in the longitudinal direction in the accumulating room to collide against a plurality of the projections of the pressure reflecting member located at the end part of the accumulating room, the reflection waves interfere with each other, the energy of the pressure wave is weakened, and fuel pressure pulsation in the accumulating room is suppressed.

Further, according to the present invention, the pressure wave propagating in the longitudinal direction in the accumulating room collides with a tapered projection located at the end part of the accumulating room to be reflected irregularly from the tapered portion, and the energy of the pressure wave is weakened, resulting in decreased fuel pressure pulsation in the accumulating room.

Therefore, fuel pulsation in the accumulating room of the common rail can be suppressed by extremely simple means with a low cost system, and the occurrence of irregular fuel injection, deviation in injection timing, and lowering in engine performance caused by these nonconformities in fuel injection can be prevented without using such an electronic control device as used in the prior art.

BRIEF DESCRIPTION OF THE DRAWINGS

FIG. 3 show a second embodiment of the invention.

DETAILED DESCRIPTION OF THE PREFERRED EMBODIMENTS

A preferred embodiment of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

First Embodiment

Figure 1:
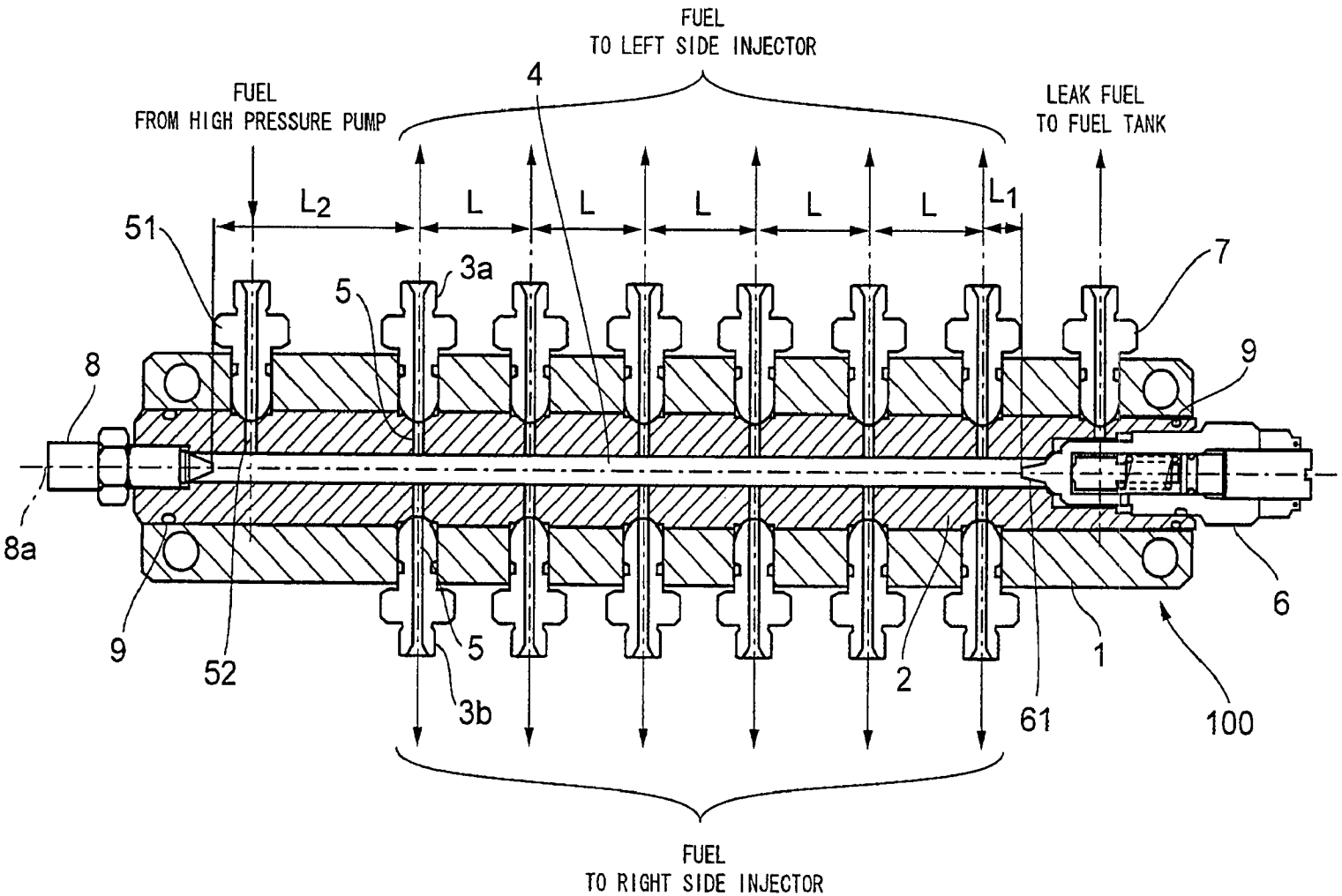
FIG. 1 is a longitudinal sectional view of the common rail of a first embodiment of the accumulator fuel injection system for a V-type diesel engine according to the present invention.
Figure 2:
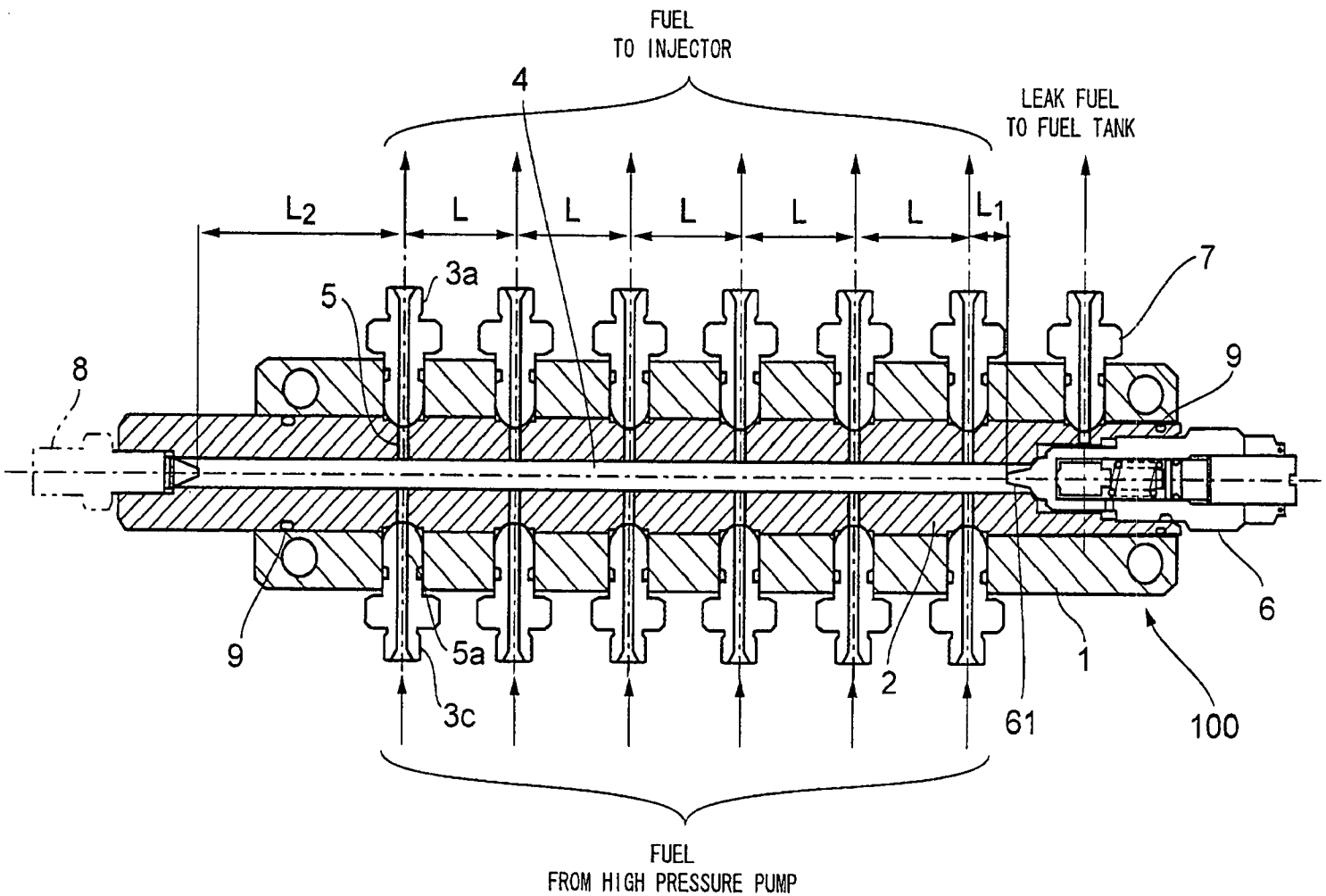
FIG. 2 is a longitudinal sectional view of the common rail of the first embodiment of the accumulator fuel injection system for an in-line diesel engine according to the present invention and corresponds to FIG. 1.

FIG. 1 is a longitudinal sectional view of the common rail of the first embodiment of the accumulator fuel injection system for a V-type diesel engine according to the present invention, and FIG. 2 is a longitudinal sectional view of the common rail of the first embodiment of the accumulator fuel injection system for an in-line diesel engine according to the present invention.

In the common rail of the accumulator fuel injection system of a 12-cylinder V-type diesel engine shown in FIG. 1, reference numeral 100 is a common rail consisting of an internal tube 2 having an accumulating room 4 extending in the longitudinal direction inside thereof and an external tube 1 into which the internal tube 2 is fitted together by insertion.

Reference numeral 3*a* represents outlet connectors connecting to fuel injection pipes (not shown in the drawing) of six left side cylinders (may be six right side cylinders). The number of the connectors is the same as that of the left side cylinders (6 cylinders in the drawing), and the connectors are screwed liquid-tight into the external tube 1 of the common rail 100 at the same spacing L along the longitudinal direction thereof.

Reference numeral 3*b* represents outlet connectors connecting to fuel injection pipes (not shown in the drawing) of six right side cylinders (may be six left side cylinders). The number of connectors is the same as that of the right side cylinders (6 cylinders in the drawing), and the connectors are screwed liquid-tight into the external tube 1 of the common rail 100 at the same spacing L along the longitudinal direction thereof.

Reference numeral 5 represents outlet passages for high pressure fuel connecting the accumulating room 4 to the outlet connectors 3*a* and 3*b*.

Reference numeral 51 is an inlet connector screwed liquid-tight into the external tube 1 at the periphery near an end thereof and connected to a high pressure pump (not shown in the drawing) by the medium of a fuel inlet pipe (also not shown in the drawing).

Reference numeral 52 is an inlet passage for high pressure fuel connecting the accumulating room 4 to the inlet connector 51.

Reference numeral 6 is a relief valve screwed liquid-tight into the internal tube 2 at an end thereof for adjusting the pressure in the accumulating room 4. Reference numeral 7 is a return connector screwed into the exterior tube 1 at the periphery near the end where the relief valve 6 is screwed into the internal tube 2. Fuel allowed to escape through the relief valve 6 is returned through the return connector 7 to a fuel tank (not shown in the drawing).

Reference numeral 8 is a pressure sensor to detect the fuel pressure in the accumulating room 4. The fuel pressure detected by the pressure sensor is transmitted to a fuel injection control system (not shown in the drawing) by the medium of a cable 8*a*.

In the common rail of the accumulator fuel injection system of a 6-cylinder in-line diesel engine shown in FIG. 2, reference numeral 3*c* represents inlet connectors provided for each cylinder for introducing high-pressure fuel from a high-pressure pump(not shown in the drawing) into the accumulating room 4, which are provided instead of the inlet connector 51 of FIG. 1. The connectors 3*c* are the same in number to that of the cylinders (6 cylinders in the drawing), screwed liquid-tight into the exterior tube 1 on the periphery thereof, and connected to the high pressure pump by the medium of fuel inlet pipes (not shown in the drawing). Reference numeral 5*a* are high pressure fuel inlets connecting the connectors 3*c* to the accumulating room 4.

The configuration otherwise is the same as that of FIG. 1 and the same constituent members are indicated by the same reference numerals.

Figure 6:
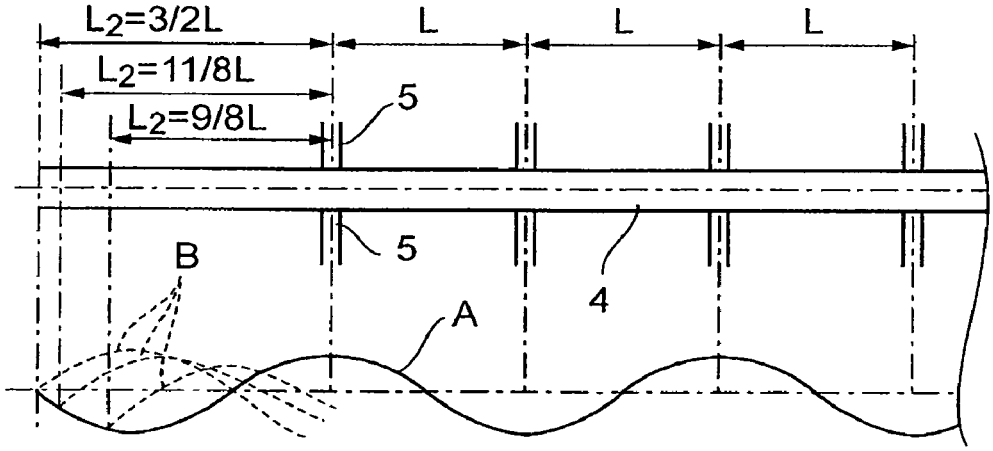
FIG. 6 is a drawing(case 1) showing the relation between the distance from the end of the pressure sensor to the high pressure fuel outlet nearest to the end and a reflecting wave of the fundamental pressure wave of fuel pressure pulsation in the accumulation room in the case of the first embodiment.

In the first embodiment of the invention, the high pressure fuel outlets 5 are arranged such that the distances $L_1$, from the right side end of the accumulating room 4 to the high pressure fuel outlet adjacent to the right side end, and $L_2$, from the left side end thereof to the high pressure fuel outlet adjacent to the left side end, are in a range of L (N+0.25) to L (N+0.375) respectively in both cases of the accumulator fuel injection system of the 12-cylinder V-type diesel engine of FIG. 1 and the 6-cylinder in-line diesel engine of FIG. 6. The pressure wave, propagating in the longitudinal direction thereof, is reflected from the ends of the accumulating room 4 and N is a nonnegative integer.

In the first embodiment of the invention, it is also suitable that the distance $L_1$ from the end of the relief valve 6 in the accumulating room 4 to the high pressure fuel outlets nearest to the relief valve 6 is half the array pitch L of the outlets 5, i.e. $L_1=\frac{1}{2}\cdot L$ and the distance $L_2$ from the end of the of the pressure sensor 8 in the accumulating room 4 to the high pressure fuel outlets 5 nearest to the pressure sensor 8 is $\frac{3}{2}$ times the array pitch L of the outlets 5, i.e. $L_2=\frac{3}{2}\cdot L$.

The wave length of fuel pressure pulsation caused by fuel injection is 2 L/m, where m is a nonnegative integer excluding zero.

Figure 7:
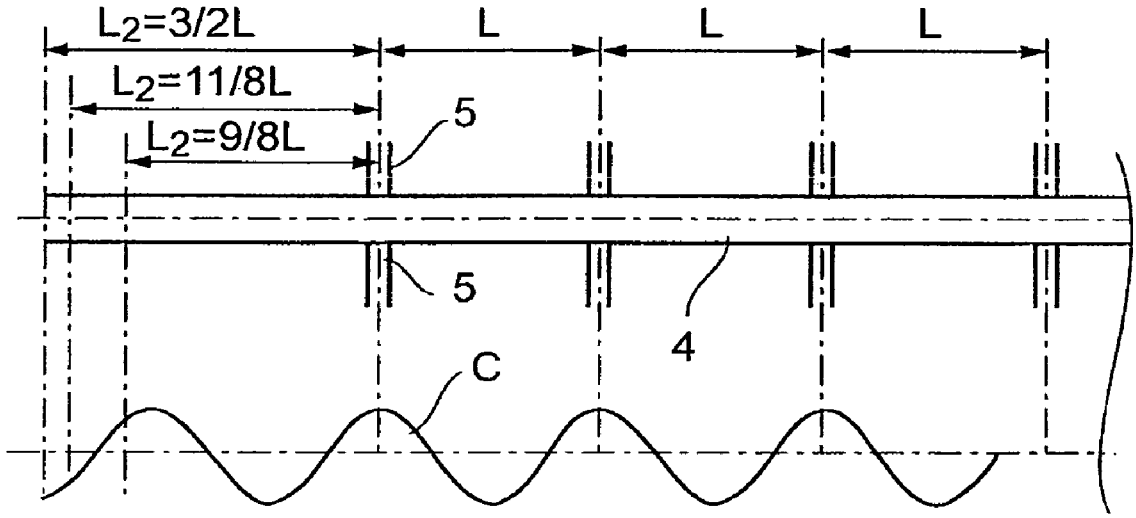
FIG. 7 is a drawing(case 2) showing the second harmonic of the pressure wave.
Figure 8:
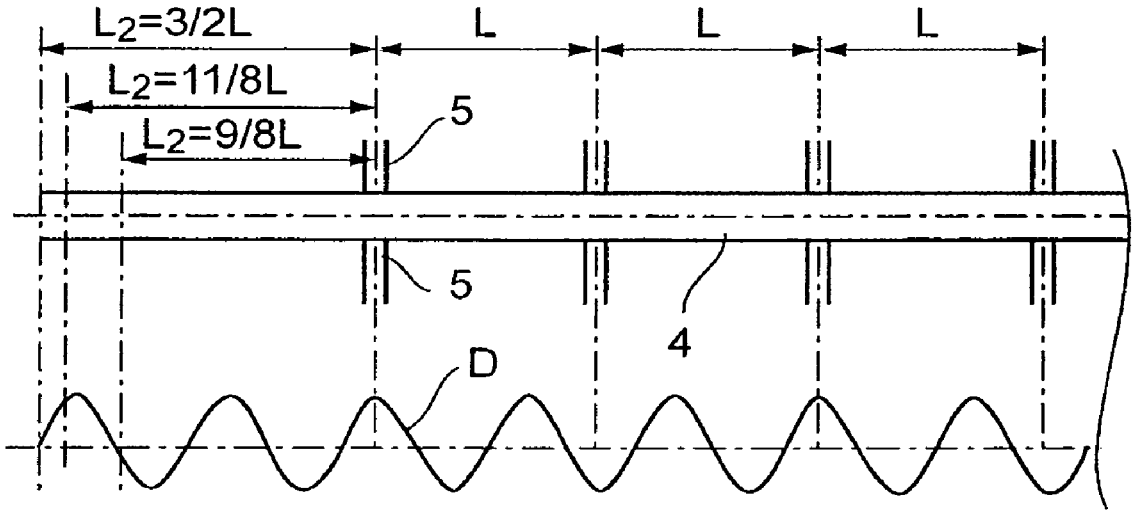
FIG. 8 is a drawing(case 3) showing the third harmonic of the pressure wave.

In FIG. 6 is shown the relation between the distance from the end of the pressure sensor 8 to the high pressure fuel outlet 5 nearest to the end and the reflecting wave of the fundamental pressure wave of fuel pressure pulsation in the accumulation room. In FIGS. 7 and 8 is shown the second (m=2) and third(m=3) harmonic of the pressure wave with three positions of the end of the pressure sensor being designated by chain lines respectively. In FIGS. 6-8, the parts the same as those of FIGS. 1-2 are indicated by the same reference numerals.

In FIG. 6 showing the fundamental wave, fuel pressure pulsation caused by fuel injection is indicated by A, and waves reflected from the end of the accumulating room, i.e. the end of the pressure sensor, are indicated by B.

In FIG. 6, when $L_2=\frac{3}{2}\cdot L$, pressure pulsation A and reflected wave B balance each other out. When $L_2=\frac{11}{8}\cdot L$, pressure pulsation A is countered with reflected wave B in large part. When $L_2=\frac{9}{8}L$, pressure pulsation A is countered partly and amplified partly with reflected wave B.

In FIG. 8, showing third harmonic wave D, the wave D will be countered most effectively with its reflected wave (not shown in the drawing) when $L_2=\frac{3}{2}\cdot L$ and when $L_2=\frac{9}{8}\cdot L$, as can be inferred from the example of FIG. 6.

As to the second harmonic C shown in FIG. 7, the wave C will be countered most effectively with its reflected wave (not shown in the drawing) when $L_2$ is the middle between 11/8·L and 9/8·L.

Although FIGS. 6-8 represent when N=1, the above description is true when N is a nonnegative integer other than 1.

In the first embodiment, when the distance from an end of the accumulating room to a high pressure fuel outlet adjacent to the end is determined in a range of (N+0.25) times to (N+0.375) times the pitch length L of the high pressure fuel outlets, effect of counteraction of the fuel pressure pulsation with its reflected wave is decreased for the fundamental wave as shown in FIG. 6, but increased for the second and third harmonic wave. Therefore by determining $L_1$ and $L_2$ in a range as above, counteraction with the reflected wave in pressure waves other than the fundamental pressure wave can be secured.

Therefore, fuel pressure pulsation in the accumulating room 4 is suppressed, and occurrence of irregular fuel injection, deviation in injection timing, and lowering of engine performance caused by these nonconformities in fuel injection can be prevented.

Second Embodiment

Figure 3A:
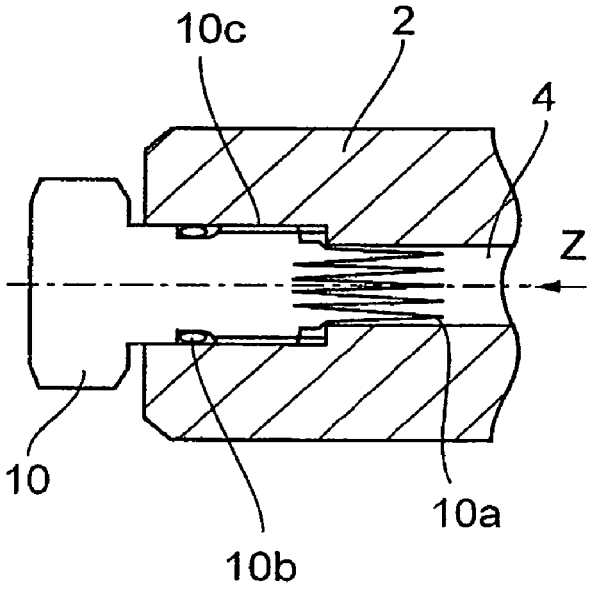
FIG. 3A is an enlarged view of the end part of the common rail.
Figure 3B:
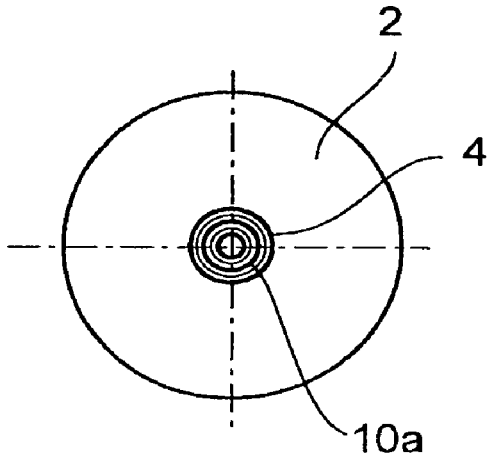
FIG. 3B is a view in the direction of the arrow Z in FIG. 3A.

FIG. 3A and FIG. 3B show the second embodiment of the invention, FIG. 3A is an enlarged view of the end part of the common rail, and FIG. 3B is a view in the direction of the arrow Z in FIG. 3A.

In the second embodiment, a pressure reflecting member 10 is screwed fluid-tight into the internal member 2 at an end of the accumulating room 4 where a pressure wave generated in the accumulating room 4 is reflected from(10*b* is an O-ring for sealing and 10*c* is the screw part). The pressure reflecting member 10 has a plurality of annular projections 10*a* projecting toward the accumulating room 4. The annular projections are formed such that each annular projection is concentric around the center of the accumulating room 4.

According to the second embodiment, when a pressure wave of the fuel pressure pulsation generated in the accumulating room 4 propagates in the longitudinal direction of the accumulating room 4 and collides against the annular projections 10*a* of the pressure reflecting member L located at an end of the accumulating room 4, the pressure wave and reflected wave reflected at different portions of the annular projections interfere with each other and the energy of the resultant wave is decreased. As a result, fuel pressure pulsation in the accumulating room 4 is dampened.

Third Embodiment

Figure 4A:
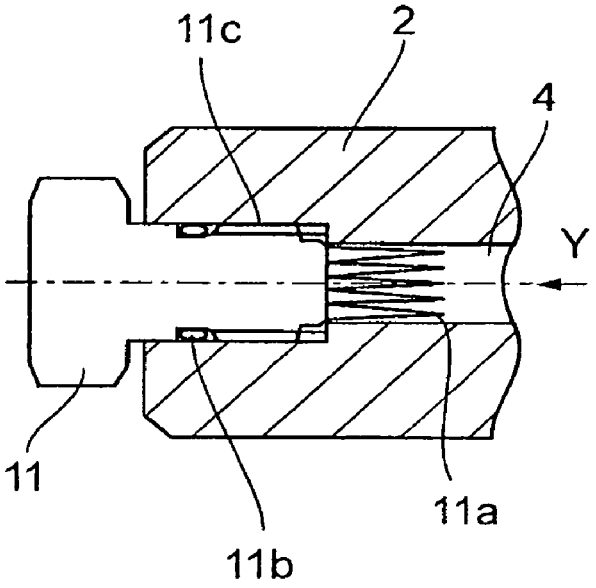
FIG. 4 show a third embodiment of the invention, FIG. 4 A is an enlarged view of the end part of the common rail.
FIG. 4B is a view in the direction of the arrow Y in FIG. 4A.
Figure 4B:
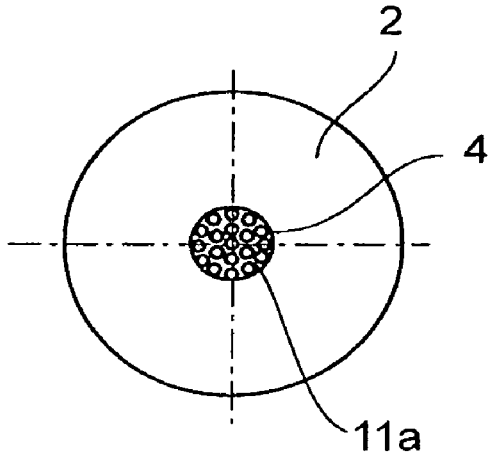

FIG. 4A and FIG. 4B show the third embodiment of the invention.

FIG. 4A is an enlarged view of the end part of the common rail, and FIG. 4B is a view in the direction of the arrow Y in FIG. 4A.

In the third embodiment, a pressure reflecting member 11 is screwed fluid-tight into the internal member 2 at an end of the accumulating room 4 where a pressure wave generated in the accumulating room 4 is reflected (11*b* is an O-ring for sealing and 11*c* is the screw part). The pressure reflecting member 11 has a plurality of acerose or needlelike projections 11*a* projecting toward the accumulating room 4.

According to the third embodiment, when a pressure wave of the fuel pressure pulsation generated in the accumulating room 4 propagates in the longitudinal direction of the accumulating room 4 and collides against the acerose or needlelike projections 11*a* of the pressure reflecting member 11 located at an end of the accumulating room 4, the pressure wave and reflected wave reflected at different portions of the acerose or needlelike projections 11*a* interfere with each other and the energy of the resultant wave is decreased. As a result, fuel pressure pulsation in the accumulating room 4 is dampened.

Fourth Embodiment

Figure 5A:
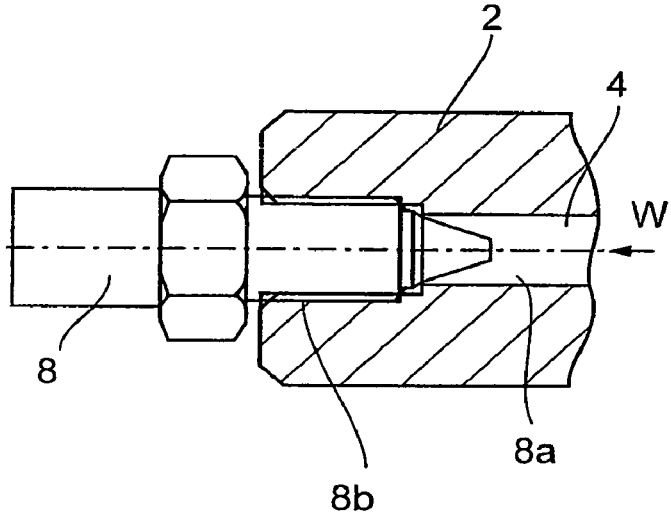
FIG. 5 show a fourth embodiment of the invention, FIG. 5 A is an enlarged view of the end part of the common rail.
FIG. 5B is a view in the direction of the arrow W in FIG. 4A.
Figure 5B:
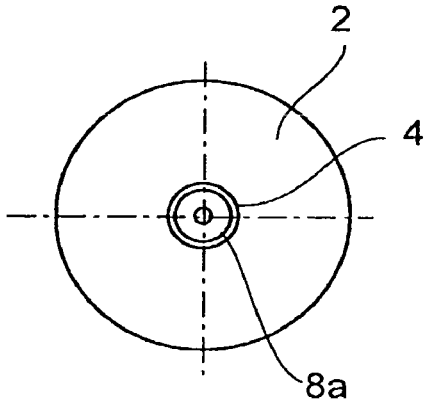

FIG. 5A and FIG. 5B show the fourth embodiment of the invention. FIG. 5A is an enlarged view of the end part of the common rail, and FIG. 5B is a view in the direction of the arrow W in FIG. 4A.

In the fourth embodiment, the pressure sensor 8, screwed fluid-tight into the internal tube 2 at an end of the accumulating room 4 where a pressure wave generated in the accumulating room 4 is reflected(8*b* is the screw part), has a tapered projection 8*a* facing the accumulating room 4.

Also, a tapered projection 61 is formed at the end of the relief valve 6 facing the accumulating room 4 as shown in FIG. 1 and FIG. 2.

According to the fourth embodiment, when a pressure wave of the fuel pressure pulsation generated in the accumulating room 4 propagates in the longitudinal direction of the accumulating room 4 and collides against the tapered projection 8*a* of the pressure sensor 8 or against the tapered projection 61 of the relief valve 6, the wave is reflected irregularly and the energy of the resultant wave is decreased. As a result, fuel pressure pulsation in the accumulating room 4 is dampened.

Fifth Embodiment

Figure 9:
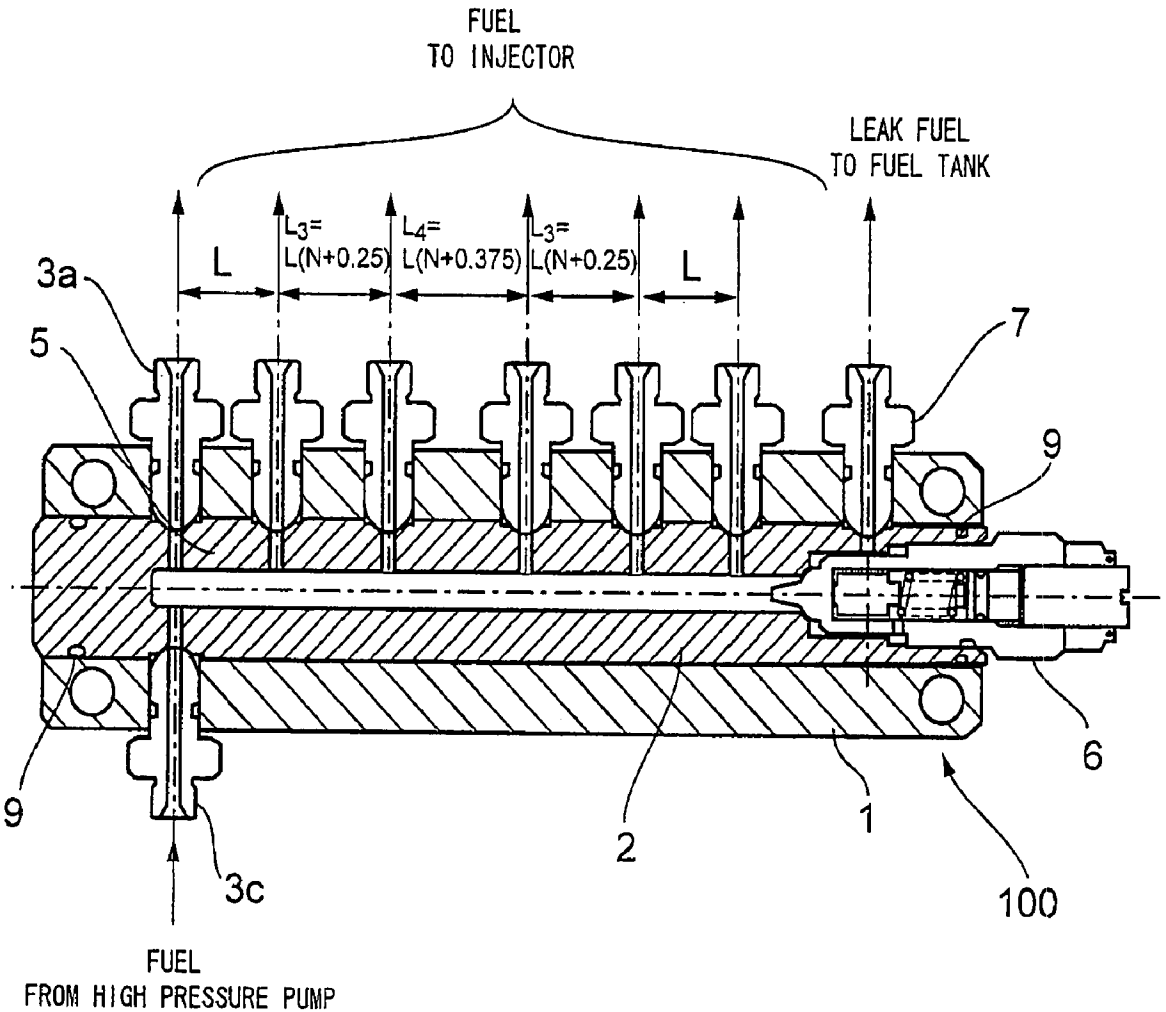
FIG. 9 is a longitudinal sectional view of the common rail of a fifth embodiment of the accumulator fuel injection system for an in-line diesel engine according to the present invention.

FIG. 9 is a longitudinal sectional view of the common rail of the fifth embodiment of the accumulator fuel injection system for an in-line diesel engine according to the present invention.

In the fifth embodiment, it is preferable that distances such as $L_3$, $L_4$ between adjacent high pressure fuel outlets each corresponding to each cylinder are determined such that $L_3$ and $L_4$ are in a range of (N+0.25) times to (N+0.375) times the shortest distance L between adjacent high pressure fuel outlets, N being a nonnegative integer.

According to the fifth embodiment, the shortest distance L between adjacent high pressure fuel outlets is taken as a reference distance and other distances between adjacent high pressure fuel outlets is determined to be in a range of (N+0.25) times to (N+0.375) times the shortest distance L. The phase of the pressure wave caused by fuel injection of a certain cylinder differs from that of the pressure wave caused by fuel injection of another cylinder, and counteraction occurs with each other.

Further, it is possible to combine the second embodiment (FIG. 3), the third embodiment(FIG. 4), and the fourth embodiment(FIG. 5) with the first embodiment shown in FIGS. 1-2.

It is also possible to combine the second embodiment (FIG. 3) the third embodiment(FIG. 4), and the fourth embodiment (FIG. 5) with the fifth embodiment shown in FIG. 9.

By combining as above, the effect of suppressing fuel pressure pulsation is further increased by the combined effect of the first or second or third embodiment with the first or fifth embodiment.

According to the present invention, an accumulator fuel injection system can be provided with which fuel pressure pulsation in the common rail caused by fuel injection can be suppressed by extremely simple means with a low cost system without using an electronic control device and so on.

What is claimed is:

1. An accumulator fuel injection system having a common rail for supplying high pressure fuel accumulated in an accumulating room of said common rail to a fuel injection valve of each cylinder through high pressure fuel outlets provided equally spaced along the longitudinal direction of said common rail at predetermined injection timing, wherein the distance from an end of said accumulating rooms, where a pressure wave generated therein is reflected from, to a high pressure fuel outlet adjacent to said end, is determined in a range of N+0.25 times to N+0.375 times the pitch length L of said equally spaced high pressure fuel outlets, each corresponding to a respective said cylinder, and N being a nonnegative integer.

2. The accumulator fuel injection system of claim 1, wherein N is $\geqq 1$.

3. An accumulator fuel injection system having a common rail for supplying high pressure fuel accumulated in an accumulating room of said common rail to a fuel injection valve of each cylinder through high pressure fuel outlets provided equally spaced along the longitudinal direction of said common rail at predetermined injection timing, wherein a distance $L_1$ from an end of said accumulating room, where a pressure wave generated therein is reflected from, to a high pressure fuel outlet adjacent to said end is ½ times the pitch length L of said equally spaced high pressure fuel outlets, each corresponding to a respective cylinder, so that $L_1 = \frac{1}{2} \cdot L$, and a distance $L_2$ from the other end of said accumulating room to a high pressure fuel outlet adjacent to said other end is ⅜ times said pitch length L, so that $L_2 = \frac{3}{2} \cdot L$.

4. The accumulator fuel injection system of claim 3, wherein N is $\geqq 1$.

5. An accumulator fuel injection system having a common rail for supplying high pressure fuel accumulated in an accumulating room of said common rail to a fuel injection valve of each cylinder through high pressure fuel outlets provided equally spaced along the longitudinal direction of said common rail at predetermined injection timing, wherein a pressure reflecting member having a plurality of projections is provided at an end part of said accumulating rooms where a pressure wave generated therein is reflected from, such that said projections are directed toward said accumulating room in the longitudinal direction.

6. An accumulator fuel injection system according to claim 5, wherein said plurality of projections of said pressure reflecting member comprises a plurality of annular projections formed such that each of said annular projections is concentric around a longitudinal center line of said accumulating room and faces toward said accumulating room.

7. An accumulator fuel injection system according to claim 5, wherein said plurality of projection of said pressure reflecting member comprises a plurality of acerose or needlelike projections formed such that each of said projections faces toward the accumulating room.

8. The accumulator fuel injection system of claim 5, wherein N is $\geqq 1$.

9. An accumulator fuel injection system having a common rail for supplying high pressure fuel accumulated in an accumulating room of said common rail to a fuel injection valve of each cylinder through high pressure fuel outlets provided equally spaced along the longitudinal direction of said common rail at predetermined injection timing, wherein a relief valve is provided at an end of said accumulating room for adjusting the pressure therein and a pressure sensor is provided at the other end of said accumulating room for detecting the pressure therein, and a tapered portion projecting toward said accumulating room in the longitudinal direction thereof is formed with one or both of said relief valve and said pressure sensor.

10. The accumulator fuel injection system of claim 9, wherein N is $\geqq 1$.

11. The accumulator fuel injection system of claim 9, wherein said tapered portion projecting toward said accumulating room is formed with both said relief valve and said pressure sensor.

12. An accumulator fuel injection system having a common rail for supplying high pressure fuel accumulated in an accumulating room of said common rail to a fuel injection valve of each cylinder through high pressure fuel outlets at predetermined injection timing, wherein said high pressure fuel outlets, each corresponding to a cylinder, are positioned unequally spaced such that at least one of the distances between adjacent said high pressure fuel outlets is determined in a range of N+0.251 times to N+0.375 times a shortest distance L between adjacent ones of said high pressure fuel outlets, N being a nonnegative integers.

13. The accumulator fuel injection system of claim 12, wherein N is $\geqq 1$.

* * * * *